US006470963B2

(12) United States Patent
Carpentier

(10) Patent No.: US 6,470,963 B2
(45) Date of Patent: Oct. 29, 2002

(54) HEAT EXCHANGER

(75) Inventor: Pierre Carpentier, Soisy-Sous-Montmorency (FR)

(73) Assignee: Societe d'Etudes et de Constructons Aeor-Navales, Gennevilliers (FR)

( * ) Notice: Subject to any disclaimer, the term of this patent is extended or adjusted under 35 U.S.C. 154(b) by 0 days.

(21) Appl. No.: 10/022,370

(22) Filed: Dec. 20, 2001

(65) Prior Publication Data

US 2002/0043363 A1 Apr. 18, 2002

Related U.S. Application Data

(62) Division of application No. 09/329,791, filed on Jun. 10, 1999.

(30) Foreign Application Priority Data

Jun. 12, 1998 (FR) ..... 98 07453

(51) Int. Cl.[7] ..... F28D 7/00; F28D 7/06; F28F 9/22; F28F 3/00

(52) U.S. Cl. ..... 165/159; 165/145; 165/176; 165/166

(58) Field of Search ..... 165/176, 166, 165/167, 157, 159, 160, 162, 145

(56) References Cited

U.S. PATENT DOCUMENTS

| | | | | |
|---|---|---|---|---|
| 1,979,975 A | * | 11/1934 | Maniscalco | 165/160 |
| 2,061,980 A | | 11/1936 | Price | |
| 2,200,787 A | | 5/1940 | Coy | |
| 2,877,000 A | * | 3/1959 | Person | 165/159 |
| 2,953,110 A | | 9/1960 | Etheridge | |
| 2,985,433 A | | 5/1961 | Simpelaar | |
| 3,513,907 A | | 5/1970 | Hughes | |
| 3,727,681 A | | 4/1973 | Fernandes | |
| 3,731,736 A | | 5/1973 | Fernandes | |
| 3,825,061 A | | 7/1974 | Bathla | |
| 3,907,032 A | | 9/1975 | DeGroote et al. | |
| 4,246,963 A | * | 1/1981 | Anderson | 165/166 |
| 4,276,927 A | | 7/1981 | Foust | |
| 4,293,033 A | * | 10/1981 | Nasser | 165/166 |
| 5,509,471 A | | 4/1996 | Hallgren | |
| 5,755,280 A | | 5/1998 | de Costa et al. | |
| 5,915,469 A | | 6/1999 | Abramzon et al. | |

FOREIGN PATENT DOCUMENTS

| | | |
|---|---|---|
| CH | 382780 | 3/1960 |
| DE | 1111221 | 7/1961 |
| FR | 882208 | 5/1943 |
| FR | 1064137 | 5/1954 |
| FR | 2080838 | 11/1971 |

* cited by examiner

*Primary Examiner*—Henry Bennett
*Assistant Examiner*—Tho V Duong
(74) *Attorney, Agent, or Firm*—Leydig, Voit & Mayer, Ltd.

(57) ABSTRACT

Parallel flat tubes are juxtaposed in a direction perpendicular to their greater axis, spaced from one another, the internal space of the tubes being divided by intercalary strips of a thermally conducting material into parallel first flowing channels as first flowing paths for a first fluid, a second fluid flowing through spaces between adjacent flat tubes.

2 Claims, 3 Drawing Sheets

Fig. 1
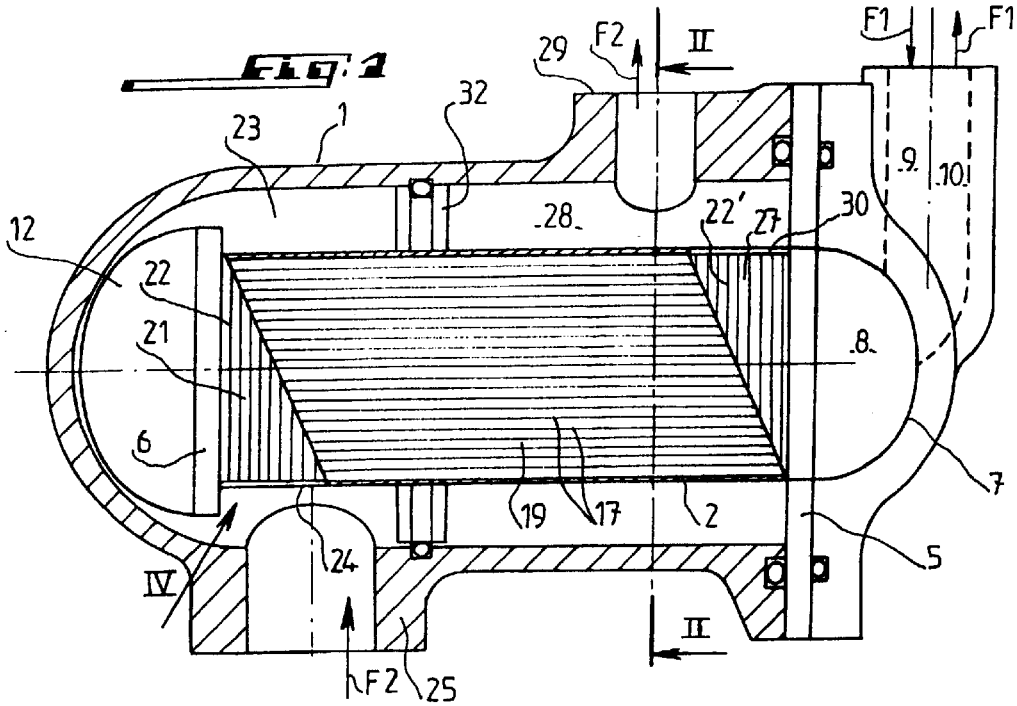
Fig. 2
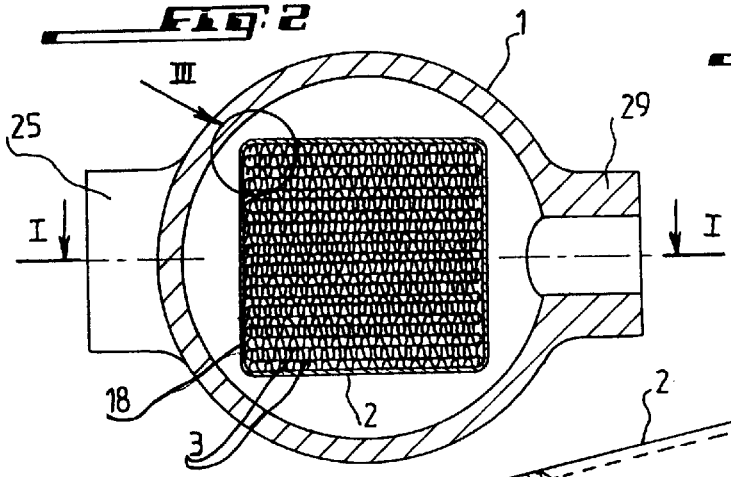
Fig. 3
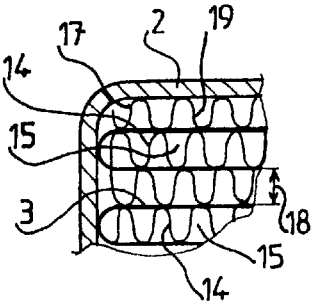
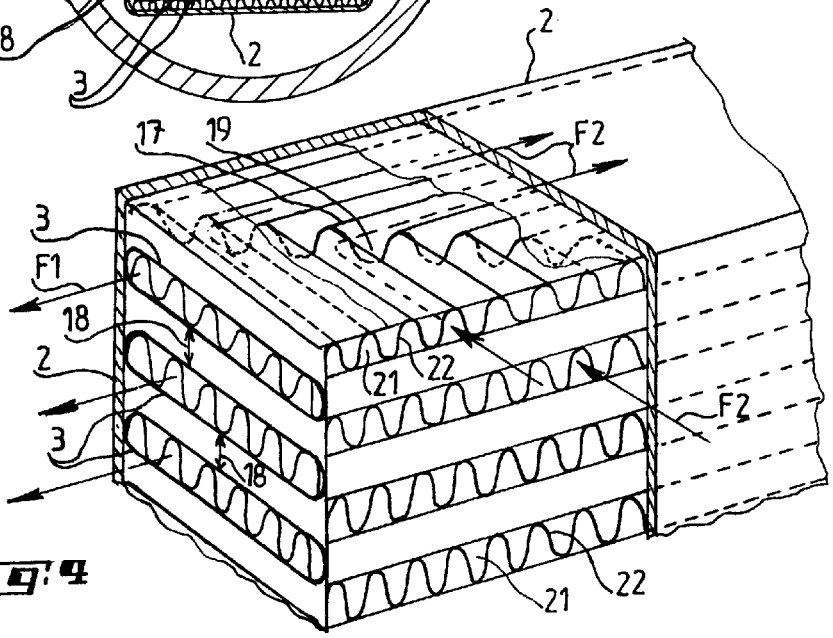
Fig. 4

Fig. 5
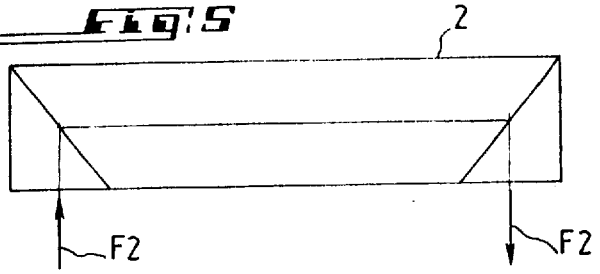
Fig. 6
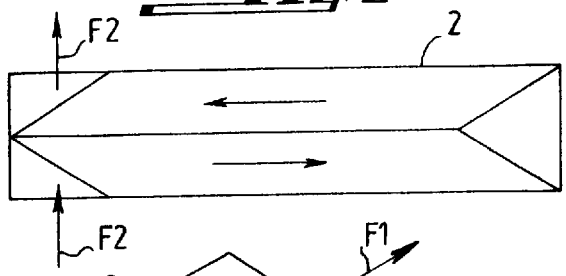
Fig. 7
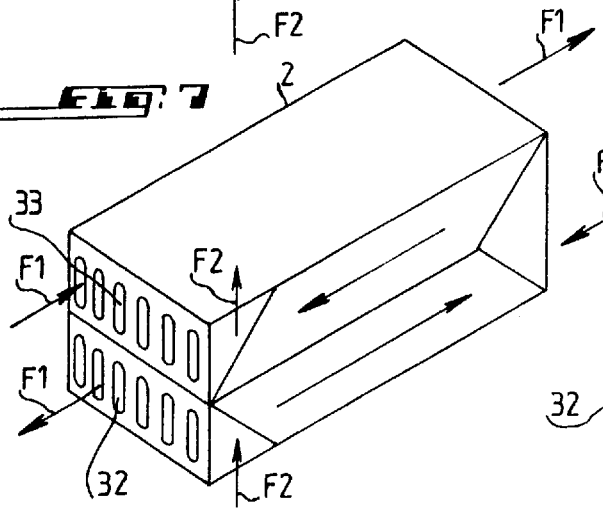
Fig. 8
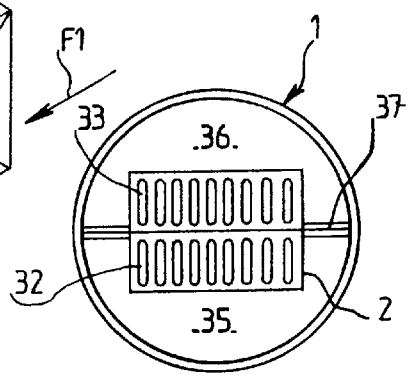
Fig. 10
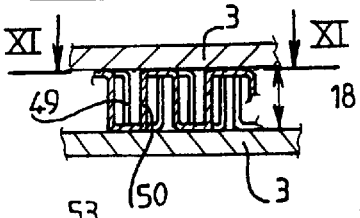
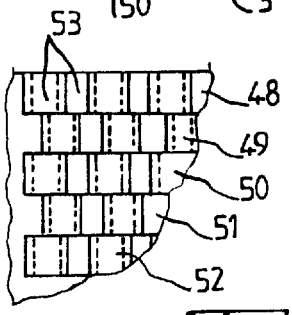
Fig. 11
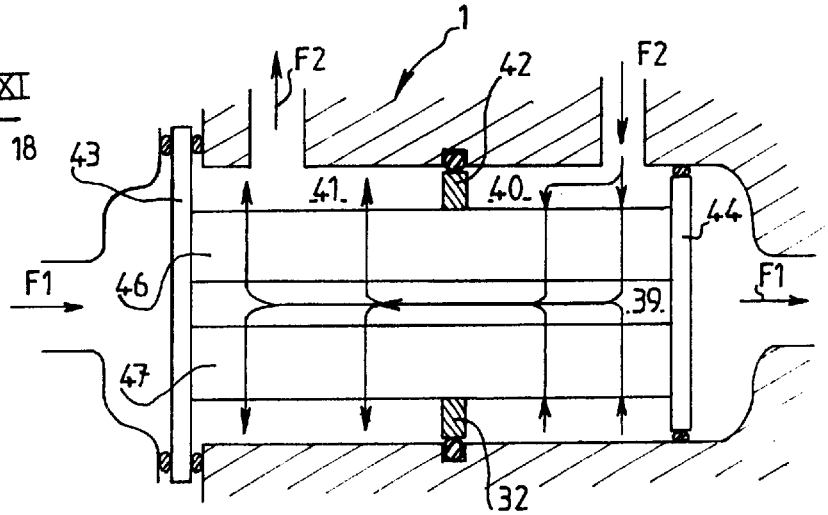
Fig. 9

HEAT EXCHANGER

FIELD AND BACKGROUND OF THE INVENTION

This invention relates to a heat exchanger in particular of a type that comprises a great number of first flowing paths of a first fluid at a first temperature, made of a thermally conducting material and extending axially in a hollow housing in which a second fluid at a second temperature, which is different from the first temperature, passes in thermal exchange contact with the first flowing paths.

In known heat exchangers, the first paths are each a separate tube. The great number of such tubes makes the construction of these heat exchangers complicated and costly. This drawback is further increased when the tubes are formed by pin-shaped tubes, each necessitating a shape with a specific length and width.

SUMMARY OF THE INVENTION

The present invention has for its object to provide a heat exchanger which does not have the drawbacks as above indicated.

To reach this object, the heat exchanger according to this invention comprises a plurality of parallel flat tubes that are juxtaposed in direction of their width within a housing at a predetermined distance, one from the other, and the inner space of which is divided by intercalary means, of a thermally conducting material, into a plurality of parallel axial channels that constitute the first flowing paths.

According to another feature of the invention, the second fluid flows through spaces between adjacent flat tubes, and each space is divided by intercalary means of thermally conducting material into a plurality of second channels.

According to still another feature of the invention, the second channels are parallel or perpendicular to the first channels and open at their two ends to a perpendicular inlet channel and a perpendicular outlet channel, communicating with inlet and outlet apertures. respectively, in the wall of the housing.

Various other features of the invention will moreover be revealed from the following detained disclosure.

BRIEF DESCRIPTION OF THE DRAWINGS

An embodiment of the invention is shown, as a non limiting example, in the accompanying drawings, wherein FIG. 1 is a cross sectional view of a heat exchanger according to the present invention, taken along line I—I of FIG. 2;

FIG. 2 is a cross sectional view taken along line II—II of FIG. 1;

FIG. 3 is an enlarged view of the portion that is encircled at III in FIG. 2;

FIG. 4 is a partly cut-away perspective view of the part shown at IV in FIG. 1;

FIG. 5 is a diagrammatic view showing an circulation profile of the fluid F2;

FIG. 6 is a diagrammatic view showing still another circulation profile of the fluid F2;

FIG. 7 is diagrammatic perspective view of another embodiment of the flat tubes and of a pin-shaped profile of the fluid F2;

FIG. 8 is a cross-sectional view of a heat exchanger fitted with the device of FIG. 7;

FIG. 9 is a diagrammatic cross-sectional view of still another embodiment of the heat exchanger of the invention, with a crossed circulation profile;

FIG. 10 is a detailed cut-away cross-sectional view of a specific profile of the fluid circulation channels;

FIG. 11 is a cross-sectional view taken along line XI—XI of FIG. 10.

DESCRIPTION OF THE PREFERRED EMBODIMENTS

Figure 12:
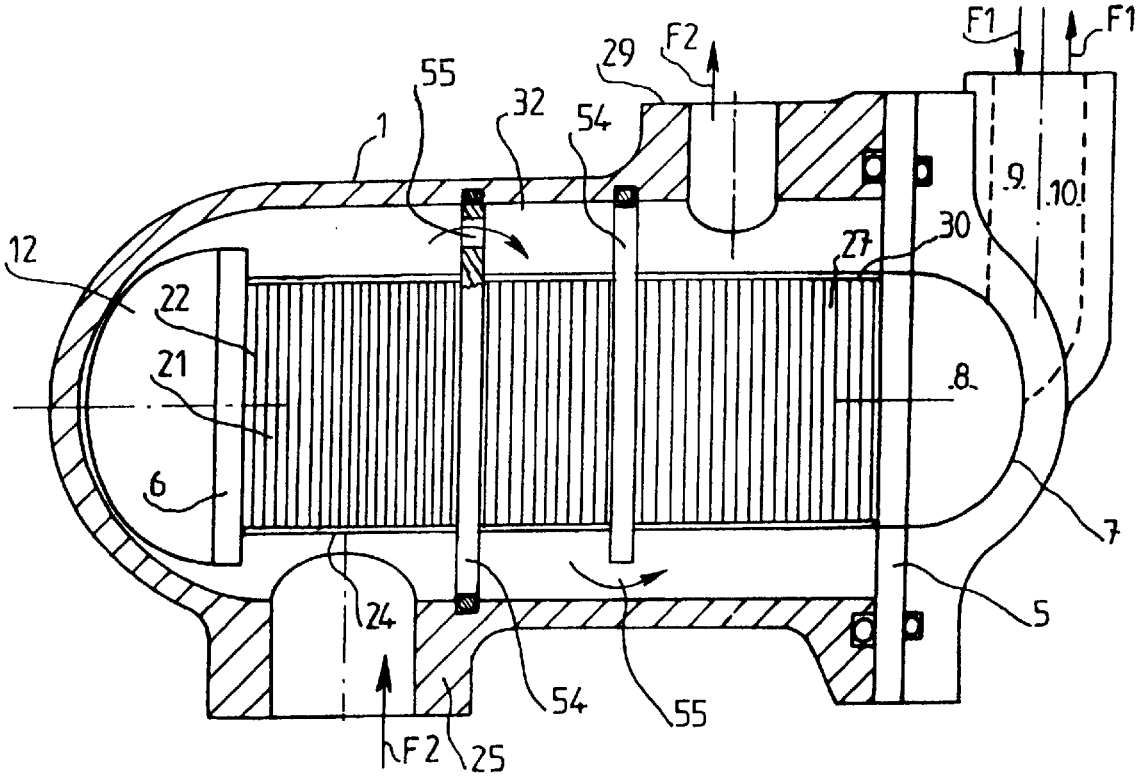
FIG. 12 is a view similar to FIG. 1 of another embodiment of the invention.

Referring now to the drawings, the heat exchanger of the invention, as shown as a non limiting example in the figures, essentially comprises a hollow housing 1 that is advantageously made of cast iron or a composite material which contains, surrounded by a casing 2, a plurality of flat tubes 3, made of a thermally conducting material, that are parallel and juxtaposed in a direction perpendicular to their cross section at a predetermined distance, one from the other.

As shown particularly in FIG. 2, the casing 2 surrounding the tubes 3 has a substantially rectangular cross-section, in the illustrated example a square cross-section, when the housing 1 has a circular cross-section.

The tubes 4 are, at each end, fitted and fixed, for example, through brazing, in a seal-tight manner, in a header plate 5 and 6, respectively. The header plate 5, shaped as a flange, is mounted on the right hand end of the housing 1, which is open and is part of an inlet and outlet header tank 7 for a first fluid F1, as shown by arrows. The inner chamber 8 of the header tank 7 is separated into two portions communicating with inlet and outlet fittings 9 and 10, respectively. The header plate 6 placed at the closed side of the housing 1 is mounted on a fluid transfer or return header tank 12. Therefore, the fluid F1 that enters through the inlet fitting 9 into the inlet part of the chamber 8 of the header tank 7 flows through one half of the tubes 3 in the direction of the header plate 6 and is sent back by the transfer header tank through the other half of the tubes 3 into the outlet fitting 11. In FIG. 2, the five upper tubes can be considered as being connected to the inlet fitting 9, and the five lower tubes to the outlet fitting 10.

The internal space of each flat tube 3 is divided by means of a corrugated intercalary strip 14 into a plurality of channels 15 that are parallel to axis of the tube (see in particular FIGS. 3 and 4). By means of an intercalary strip of a same type, that is also corrugated, the space 18 separating two adjacent flat tubes 3 is separated into a plurality of parallel channels 19. The channels 19 are parallel to the channels 15 of the flat tubes 3. By referring to FIGS. 1 and 4, there is found that the channels 19 between two tubes 3 communicate, at one end, with transverse channels 21, also formed by means of an intercalary strip 22 between the two same tubes 3 that open in an internal space portion 23 of the housing 1 through a window 24 in the side wall of the casing 2. The space portion 23 forms an inlet space for a second fluid F2 which may enter this space through an inlet fitting 25. The other end of the axial channels 19 communicate, by means of transverse channels 27, with the internal space portion 28 of the housing 1 forming the outlet space for the fluid 22 which may flow out of the housing 1 through an outlet fitting 29. Obviously, the transverse channels 27 open in the space portion 28 through a window 30 in the side wall of the casing 2. The channels 27 are also formed by a corrugated intercalary strip 22' that is placed between the same two tubes 3. The inlet and outlet spaces 23 and 28 of the housing 1 are separated by means of a seal tightness ring 32.

With respect to the connection of the transverse channels 21 and 27 and axial channels 19 between two adjacent flat tubes 3, the shapes of the intercalary strips constituting these two sets of channels are shown in FIG. 1 and more particularly in FIG. 4. Obviously, the intercalary strips are made of a thermally conducting material and are fixed by any suitable manner, in particular by brazing or gluing, onto the inner or outer faces of the tubes along their ridge lines, depending on whether it is an axial or transverse intercalary strip.

In the illustrated example, the fluid F2 flows in a Z-shaped profile, inlet at one end of the housing 1 and outlet at the other end of the housing 1, but at the opposite side, the flow being a counter-flow for the inlet flat tubes and a parallel-flow type for the outlet tubes 3.

FIG. 5 diagrammatically shows, in a view similar to FIG. 1, an arrangement of the channels 21 and 27 for obtaining U-shaped circulation of the fluid F2. FIG. 6 shows, in a diagrammatic way, the profile of the intercalary parts between tubes for obtaining a pin-shaped circulation of the fluid F2. In this case, the inlet and outlet for this fluid are on the same side of the housing 1.

FIG. 7 diagrammatically shows a construction of a heat exchanger in which the fluid 22 circulates in a counter-flow in the inlet and outlet tubes that are respectively designated by numerals 32 and 33.

FIG. 8 shows that the internal space of the housing 1 is separated into inlet and outlet portions 35 and 36 corresponding to the portions 23 and 28 of FIG. 1 by means of axial seal-tightness partition walls 37. These partition walls may be provided with valves (not shown), the opening of which is controlled in relation to temperatures of the fluids. Such valves that are temperature sensitive could advantageously be made of a shape memory material, known per se.

FIG. 9 diagrammatically shows an embodiment of the heat exchanger of the invention with a crossed profile of the circulations of the fluids F1 and F2. For this purpose, the channels for circulating the fluid F2 extend in each space between two adjacent flat tubes and between the outer tubes and the casing that surrounds them, perpendicular to these tubes. On the other hand, the axial center portion of each space between tubes, shown at 39 in FIG. 9, is available for axial flow of the fluid F2 between the inlet and outlet apertures for the fluid F2 in the housing 1, the internal space of which is divided into an inlet space 40 and an outlet space 41 separated by a sealing ring 42. The spaces 40 and 41 are delimited at ends of the housing 1 by means of header plates 43 and 44. The header plates 43 and 44 are mounted with a fluid seal in the housing 1.

In FIG. 9, the fluid F1 circulates through the heat exchanger in a single pass. Obviously, it could also flow in a pin-shaped circulation. In this case, the housing 1 is closed at the header plate 44, and the header plate 44 is part of a transfer header tank of the same type as the header tank 12 of FIG. 1. Fluid F2 could also flow according to a profile in a plurality of crossed passes. The center axial portion of the axial flow of the fluid F2 could also be achieved by providing two sets of juxtaposed flat tubes, as shown at 46 and 47 in FIG. 9.

Lastly, the channels could have any longitudinal shape, i.e., a rectilinear shape, a corrugated shape, or could even be formed by portions of intercalary parts that are laterally shifted as shown in FIGS. 10 and 11. FIG. 11 shows a plurality of portions of intercalary parts 48–52 that are shifted and form, therefore, a network of communicating zig-zag channels 53. It should be noted that it is important to the thermal performance of the heat exchanger that the exchange surface be obtained by the mounting of the intercalary parts.

Obviously, various modifications can be brought to the different variants of embodiment which have just been described, without departing from the scope of the invention. Thus, the transfer and return tank could be omitted by using pin-shaped flat tubes. Besides, the use of flat tubes enables a great reduction in the number of tubes, so that, in the case of the invention, such a pin-shaped tube profile, that implies different sizes for each tube, remains an alternative which is greatly valuable, where the transfer header plate could have a circular shape, as shown in FIG. 9.

In any event, with respect to the prior art, this invention has very important advantages over the known heat exchangers because it replaces a large number of separate tubes used in the known heat exchangers with a number of relatively small flat tubes, the inner space of which is divided, as the space between adjacent tubes, by means of intercalary strips, into a large number of channels. To the mechanical advantages of the invention, there is thus added an improvement in the thermal performance with respect to the state of the art.

Although the fluids F1 and F2 may be of any suitable kind, they are typically liquids.

It should be noted that the use of flat tubes has a very important advantage in solving the seal tightness problem which occurred in the known plate type arrangements with closing of the inner space by means of end bars. Actually, particularly when high pressure fluids are used, the seal tightness upon the assembly of the bars to the plates is questionable, and leaks are produced. Thanks to the tubes, in the case of the invention, a perfect seal tightness is provided, even with high pressure fluids.

Another major advantage of the invention lies in the fact that the assembly of the components of the heat exchanger is easy. Actually, the relatively thick header plates in which the tubes are fitted will provide, upon the assembly procedure, the necessary reciprocal holding of the parts to be assembled. This enables omission of the specific holding devices that are required upon assembly of plate type heat exchangers.

Moreover, the use of flat tubes enables the provision of heat exchangers with a plurality of transverse passes of the fluid F2, as shown in FIG. 12, without complicating the structure and mounting of the heat exchanger and without the risk of an increase in seal tightness defects. Actually, as shown in this figure, it suffices to introduce intercalary parts 22 into the spaces 18 between two adjacent flat tubes that are perfectly held by the header plates at their ends and to provide, within the housing 1, suitable transverse partition walls 54 that are fixed at one end to the housing 1 by leaving, at the other end, a passage 55 in order to cause the fluid F2 to pass in a multipass flow as shown arrows. The passage 55 could be a window in a partition wall fixed in a seal-tight manner to the housing, as shown at the left hand side of FIG. 12.

What is claimed is:

1. A heat exchanger comprising:

a hollow housing;

a plurality of flat tubes, each flat tube having an internal space and, in cross-section, larger and smaller axes perpendicular to each other, said flat tubes being stacked in a direction perpendicular to the larger axis, parallel and spaced from each other;

first intercalary means made of a thermally conducting material and disposed within the internal spaces within said flat tubes, dividing the internal spaces of said flat tubes into a plurality of first flow channels for flow of a first liquid at a first temperature, the first flow channels extending axially in said hollow housing;

second intercalary means made of a thermally conducting material and disposed between adjacent pairs of said flat tubes, dividing spaces between adjacent pairs of said flat tubes into a plurality of second flow channels for a second fluid, a first fluid flowing at a first temperature through the first flow channels being in thermal exchange with a second fluid flowing at a second temperature, different from the first temperature, through the second flow channels;

an inlet/outlet header tank including an inlet/outlet header plate sealed to first ends of said flat tubes for flow of the first fluid, said inlet/outlet header plate being rigidly secured to said hollow housing; and a fluid return header tank including a header plate to which second ends of said flat tubes are sealed for returning flow of the first fluid, said header plate not being connected to said hollow housing, wherein said inlet/outlet header is separated into an inlet portion and an outlet portion, said plurality of flat tubes comprises flat tubes extending between the inlet portion of said inlet/outlet header and said fluid return header tank, and flat tubes extending between said fluid return header tank and the output portion of said inlet/outlet header, said hollow housing comprises an inner space separated by a partition wall into at least first and second space parts, the first space part being a second fluid inlet space and the second space part being a second fluid outlet space, said hollow housing comprises inlet and outlet openings communicating respectively with said second fluid inlet space and said second fluid outlet space and situated adjacent said inlet/outlet header and said fluid return header, respectively, and said second flow channels comprise channels extending in said second fluid inlet space, transverse to an axis of said hollow housing, in one direction, and channels extending in said hollow housing, transverse to the axis of said hollow housing, in a direction opposite to said channels extending in said second fluid inlet space, transverse to the axis of said hollow housing, and said first and second space parts communicate with one another through an opening in said partition wall.

2. The heat exchanger as set forth in claim 1, wherein said first and second intercalary means comprise corrugated strips fixed to inner and outer surfaces of said flat tubes.

* * * * *